United States Patent [19]

Morrell et al.

[11] 4,171,549

[45] Oct. 23, 1979

[54] CUSHION ENSEMBLE AND METHOD OF ARRANGING CUSHIONS TO PROVIDE THE SAME

[76] Inventors: Bradford D. Morrell; Harold A. Gray, both of 4721 Linnean Ave., NW., Washington, D.C. 20008

[21] Appl. No.: 831,222

[22] Filed: Sep. 7, 1977

[51] Int. Cl.[2] ..... A47C 27/00

[52] U.S. Cl. ..... 5/465

[58] Field of Search ..... 5/91, 345 R, 338, 357, 5/352

[56] References Cited

U.S. PATENT DOCUMENTS 4,055,866 11/1977 Evans ..... 5/352

FOREIGN PATENT DOCUMENTS 778039 2/1968 Canada ..... 5/352

565533 8/1975 Switzerland ..... 5/338

*Primary Examiner*—Kenneth J. Dorner

*Attorney, Agent, or Firm*—Bacon & Thomas

[57] ABSTRACT

A plurality of wedge-shaped cushions are arranged in an ensemble to form a body supporting device in the nature of a chair or lounge. A first, large, wedge-shaped cushion and a second, smaller, wedge-shaped cushion are arranged in a common plane so that their upwardly facing sides converge downwardly toward each other. A third wedge-shaped cushion is placed on the generally upwardly facing, inclined surface of the first cushion to serve as a shoulder, neck, or back rest. The relative positions of the various cushions are varied to effect varying body positions between reclining positions and upright sitting positions.

16 Claims, 10 Drawing Figures

CUSHION ENSEMBLE AND METHOD OF ARRANGING CUSHIONS TO PROVIDE THE SAME

BACKGROUND AND OBJECTS

1. Field of the Invention

The field of the present invention is furniture such as chairs and lounges. In particular, the invention relates to a cushion ensemble, the overall configuration of which may be varied to provide various body postures.

2. Description of the Prior Art

It has been known to provide furniture capable of variation in configuration to effect different body postures, such as convertible chairs and sofas, reclining chairs and so-called "bean-bag" chairs such as that disclosed in U.S. Pat. No. 3,889,210 to Samhammer et al. It has also been known to provide cushions for effecting various body postures such as shown in U.S. Pat. No. 3,003,815 to Zinn.

3. Objects

Objects of the present invention include providing an improved method and means for supporting a body in various positions which is simple and inexpensive and which, with the use of only relatively few elements, provides full and complete body support in a relatively large number of postures between upright sitting postures and nearly prone reclining postures. Other objects and advantages of the present invention will be apparent from the accompanying detailed description and drawing.

SUMMARY

To achieve the foregoing objects, a cushion ensemble is provided which includes first and second generally wedge-shaped cushions which are free about their entire exteriors, one angle forming the wedge-shape of each cushion being smaller than the other angles of the wedge. The first and second cusions are arranged so that each has a side disposed in a common plane with the other and such that the smaller angles of each face each other in mutually opposed relationship. The upwardly facing sides of the first and second cushion will be inclined downwardly toward each other and toward the common plane. A third cushion is disposed on a generally upwardly facing but inclined side of the first cushion in unattached, abutting relationship therewith. The three cushions are arranged in various relative dispositions and relationships to provide varying body postures between a reclining posture and certain upright sitting postures.

One upright sitting posture may involve use of a fourth cushion which is also free about its entire exterior and which has a cross-sectional shape corresponding generally to a four-sided closed geometrical figure with three acute internal angles and one internal angle which is greater than 180°. The greater angle defines an inwardly converging recess with respect to the exterior of the fourth cushion, and the fourth cushion is placed on the third cushion such that the recess mates with one corner and two sides of the third cushion.

Each cushion is filled with polystyrene beads. As such, each cushion deforms substantially under the weight of a body.

DETAILED DESCRIPTION

Figures 1, 2, 3, 4:
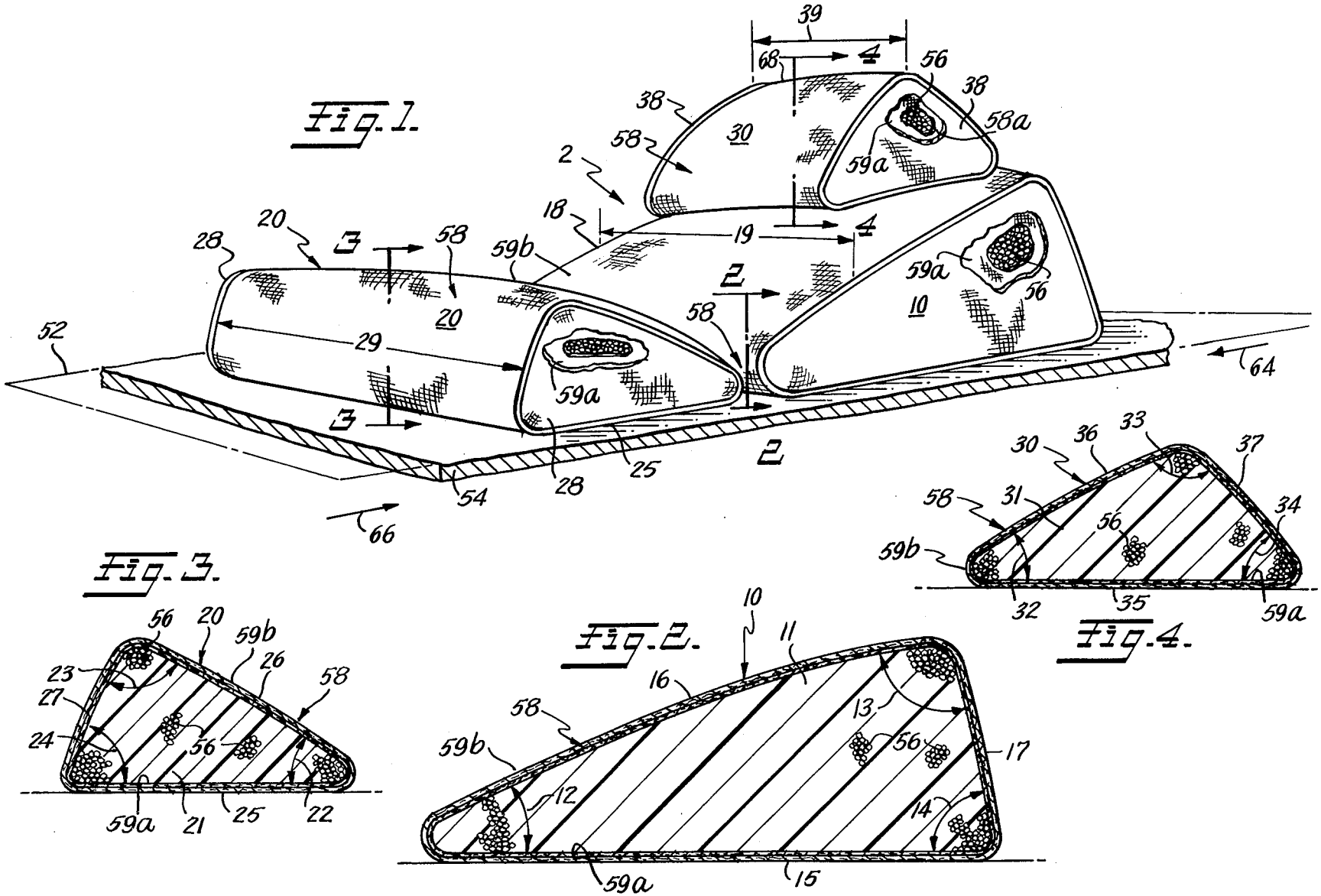
FIG. 1 is an isometric view of a cushion ensemble according to the present invention depicting first, second and third cushions arranged to effect a first, semi-reclining body posture.
FIG. 2 is a vertical cross-section taken on line 2—2 of FIG. 1 depicting the cross-sectional shape of the first cushion of the cushion ensemble.
FIG. 3 is a vertical cross section taken on the line 3—3 of FIG. 1 depicting the cross-sectional shape of the second cushion of the cushion ensemble of FIG. 1.
FIG. 4 is a vertical cross section taken on the line 4—4 of FIG. 1 depicting the cross-sectional shape of the third cushion of the cushion ensemble of FIG. 1.

In the following description, and in the drawing, like reference characters are used to designate like elements or features among the various figures of the drawing.

Referring to FIGS. 1, 5, 6, 7, 8 and 10, reference character 2 generally refers to the cushion ensemble of the present invention. The cushion ensemble 2 is shown in various different conditions in the foregoing figures, certain of the different conditions effecting different body postures.

Referring to FIGS. 1 and 2, ensemble 2 includes a first cushion 10 which is free about its entire exterior. In this regard, the term "free" refers to the characteristic of being unattached to any other adjoining cushion or object. As is apparent from the drawing, "free" cushion 10 may engage or be engaged by other cushions or objects.

Referring specifically to FIG. 2, first cushion 10 has a cross-sectional shape corresponding generally, in an undeformed condition, to a first triangle 11 having angles 12, 13 and 14 defined by a first long side 15, a second long side 16 and a short side 17. One angle 12 of cushion 10 is smaller than the other two angles 13, 14. The smaller angle 12 of triangle 11 is defined by the first and second long sides 15 and 16. Reference characters 15, 16 and 17 are used to refer both to sides of the triangle 11 (with regard to two-dimensional characteristics such as in FIG. 2) as well as to sides of the wedge-shaped cushion 10 (with regard to three-dimensional characteristics such as in FIG. 1). First cushion 10 includes a pair of opposed, spaced, parallel lateral sides 18 having essentially the same shape as triangle 11. First cushion 10 has a width dimension 19 (FIG. 1) taken in a direction perpendicular to the plane of the first triangle 11.

Ensemble 2 includes a second cushion 20 which is also free about its entire exterior. Second cushion 20 has a cross-sectional shape corresponding generally, in an undeformed condition, to a second triangle 21 (FIG. 3). Second triangle 21 includes angles 22, 23, and 24 defined by a first long side 25, a second long side 26, and a short side 27. One angle 22 of the second triangle 21 is smaller than the other two angles 23, 24. Smaller angle 22 is defined by the first and second long sides 25, 26. Reference characters 25, 26 and 27 refer both to sides of the second triangle 21 (when considered from the two-dimensional standpoint as in FIG. 3) as well as to the sides of the cushion 20 (when considered from the three-dimensional standpoint as in FIG. 1). Second cushion 20 has a pair of opposed, spaced, parallel, lateral sides 28 having essentially the same shape as triangle 21. Second cushion 20 has a width dimension 29 taken in a direction perpendicular to the plane of the second triangle 21.

Cushion ensemble 2 also includes a third cushion 30 which, again, is free about its entire exterior. Third cushion 30 has a cross-sectional shape corresponding generally, in an undeformed condition, to a third triangle 31 as seen in FIG. 4. Triangle 31 includes angles 32, 33, and 34 defined by a long side 35, an intermediate side 36, and a short side 37. One angle 32 of triangle 31 is smaller than the other two angles 33, 34. Smaller angle 32 is defined by long side 35 and intermediate side 36. Reference characters 35, 36 and 37 refer both to the sides of the third triangle 31 (from the two-dimensional standpoint of FIG. 4) as well as to the sides of the third cushion 30. In addition to sides 35, 36 and 37, cushion 30 has a pair of oppositely disposed, parallel lateral sides 39 having essentially the same shape as third triangle 31. Third cushion 30 has a width dimension 39 taken in a direction perpendicular to the plane of the third triangle 31.

Figure 9:
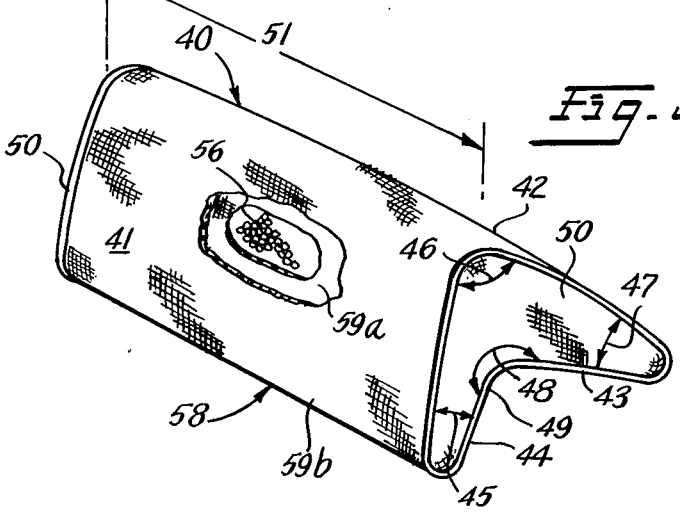
FIG. 9 is an isometric view of a fourth cushion to be used in a cushion ensemble of the present invention.
Figure 10:
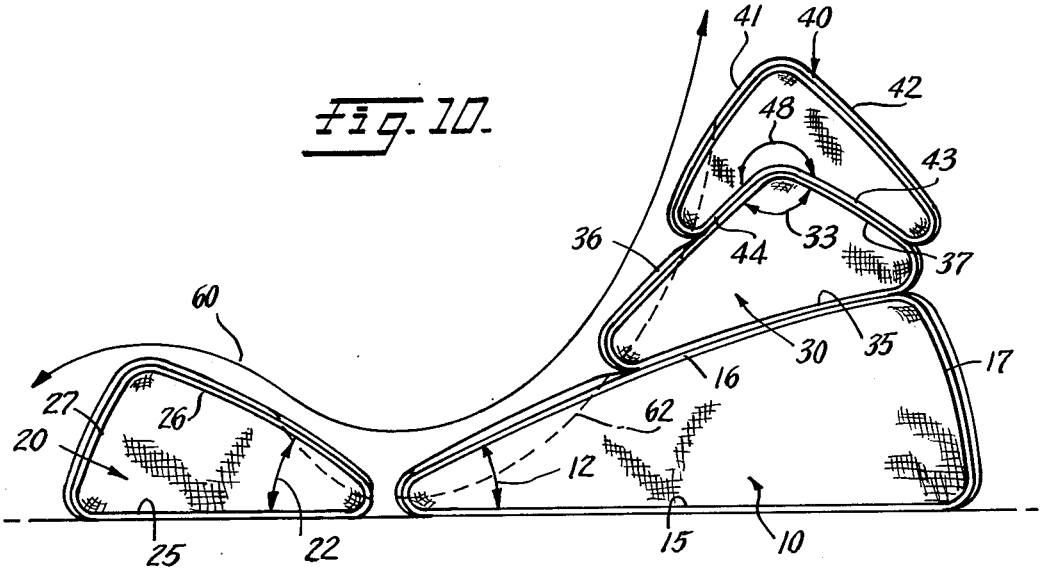
FIG. 10 is a side elevation of a cushion ensemble wherein the first, second, third and fourth cushions are arranged to effect a second, semi-upright body posture.

For the particular condition of ensemble 2 shown in FIG. 10, there may be a fourth cushion 40 which is illustrated separately in FIG. 9. Fourth cushion 40 is free about its entire exterior and has a cross-sectional shape corresponding generally in an undeformed condition, to a geometrical figure having four sides 41, 42, 43 and 44 with three acute internal angles 45, 46, 47 and one internal angle 48 which is greater than 180°. It will be apparent that such cross-sectional shape is the shape defined by a vertical section through fourth cushion 40 and taken in the same manner as the sections on the lines 2—2, 3—3 and 4—4, respectively, of the other cushions 10, 20 and 30.

Internal angle 48 defines an inwardly converging recess 49 with respect to the exterior of fourth cushion 40. Fourth cushion 40 includes a pair of oppositely disposed, parallel lateral sides 50 having substantially the same shape as the above-described vertical cross-sectional shape of the overall fourth cushion 40. Fourth cushion 40 has a width dimension 51 taken in a direction perpendicular to the vertical plane in which the above-described four-sided geometrical figure is defined and perpendicular to lateral sides 50.

As can best be appreciated by reference to FIG. 1, the width dimensions 19, 29 of the first and second cushions 10, 20 are substantially greater than the width dimension 39 of the third cushion 30. Preferably, width dimensions 19, 29 are at least 1.5 times the width dimension 39 of the third cushion 30. Preferably too, the width dimension 51 of the fourth cushion will be substantially the same as the width dimension 39 of the third cushion.

As will also be apparent from the drawing, the first cushion 10 is substantially larger in its overall size than the second and third cushions 20, 30. In particular, the lengths of the first and second long sides 15, 16 of the first cushion are at least 1.5 times the lengths, respectively, of the first and second long sides 25, 26 of the second cushion 20 and at least 1.5 times the lengths, respectively, of the intermediate and long sides 35, 36 of the third cushion 30.

In one actual physical embodiment of the ensemble 2 of the present invention, the first cushion 10 had a smaller angle 12 of 24°, an angle 13 of 77°, an angle 14 of 80°, a first long side 15 of 27 inches, a second long side 16 of 24.25 inches and a short side 17 of 11.25 inches. In the same actual physical embodiment of ensemble 2, the second cushion 20 had a smaller angle 22 of 34°, an angle 23 of 75°, an angle 24 of 71°, a first long side of 13.75 inches, a second long side 26 of 13.50 inches and a short side 27 of 8 inches. Finally, in the same physical embodiment, third pillow 30 had a smaller angle 32 of 34°, an angle 33 of 92°, and an angle 34 of 54°, a long side 35 of 15.50 inches, an intermediate side 36 of 12.50 inches and a short side 37 of 8.75 inches. With such dimensions, two standard queen size flat sheets, both together having a total area of 9,900 square inches, will provide the material to make liners for exactly three cushion ensembles 2 of the type shown in FIG. 1.

In FIG. 1, phantom lines 52 indicate a common plane in which the first and second cushions 10, 20 are arranged. Typically, common plane 52 will be defined by a floor 54 of a building, but it may be defined by any suitable supporting surface.

Each cushion 10, 20, 30, 40 is filled with plastic beads 56 enclosed by outer walls of a flexible material 58, such as woven cloth. Flexible material 58 preferably includes an inner liner **59*a* (see FIGS. 2–4) which is of a relatively thin material such as that of which standard bed sheets are constructed. Flexible material 58 also preferably includes a thicker outer cover 59*b* such as that typically used in upholstering furniture. Inner liner 59*a* completely contains beads 56. Preferably, too, outer material 59*b* includes horizontally extending zippers (not shown) to enable removal of outer cover 59*b* from filled liner 59*a* for cleaning the outer cover 59*b***.

Beads 56 are preferably made of styrene, and each individual cushion is of similar construction to the devices known in the furniture trade as "bean-bag" chairs. A bean-bag chair is disclosed in U.S. Pat. No. 3,899,210 which is hereby incorporated by reference.

Each cushion 10, 20, 30 and 40 of the ensemble 2 of the present invention is constructed to be slightly more rigid and more shape retaining than the cushion of a typical "bean-bag" chair. Nevertheless, cushions 10, 20, 30, and 40 deform substantially under the weight of the user's body 60 as shown by phantom lines 62 in the drawing. That is, each cushion remains moderately variable in shape so as to mold itself to the body contours of an occupant in use. To attain the desired deformation characteristics of cushions 10, 20, 30, 40, the beads 56 are expanded to only about half the extent of the expansion of beads in standard, commercially available "bean-bag" chairs. Also, the individual cushions 10, 20, 30 and 40 are packed more fully and more tightly. The smaller than usual expansion of beads 56 helps prevent loss of firmness and resiliency after a period of use. Since beads 56 are more dense and firm than usual, they have less of a tendency to collapse under compression.

In view of the nature of construction of the individual cushions 10, 20, 30, 40, and as will be apparent from the drawing, the cushions do not assume sharply defined geometrical shapes. Obviously, the corners defined by the various angles are rounded, and the sides are not perfectly flat. Thus, it will be understood that the geometrical relationships defined and discussed herein are not strict geometrical relationships in the mathematical sense. Rather, they refer to the general overall shapes and relationships which may be discerned by an ordinary person without regard to mathematical and graphical precision.

Referring again to FIGS. 1, 5, 6, 7, 8 and 10, first and second cushions 10, 20 are arranged such that first long sides 15, 25 thereof are disposed in the common, horizontal plane 52. As shown in the same figures, first and second cushions 10, 20 are also positioned such that the smaller angles 12, 22 thereof face each other in mutually opposed relationship. When so positioned, second long side 16 of first cushion 10 faces upwardly and is inclined downwardly toward common plane 52 in a first horizontal direction 64 along plane 52, and second long side 26 of second cushion 20 faces generally upwardly but is inclined downwardly in a second horizontal direction 66 (FIG. 1) along plane 52, the second direction 66 being opposite to the first direction 64. In other words, second long sides 16, 26 are inclined downwardly toward each other and toward common plane 52. As will also be seen from FIGS. 1, 5, 6, 7, 8, and 10, third cushion 30 is placed on first cushion 10 in unattached abutting engagement with the upwardly facing, second long side 16 of first cushion 10.

Figure 5:
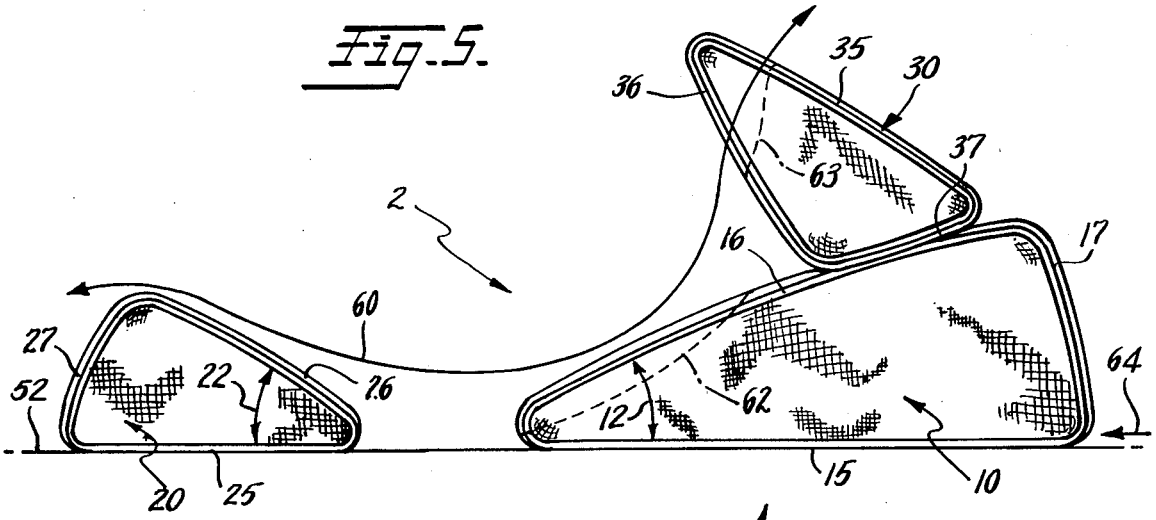
FIG. 5 is a side elevation of a cushion ensemble wherein the first, second and third cushions are arranged to effect a reclining body posture.

FIG. 5 shows an arrangement of cushions 10, 20, and 30 to effect a reclining body posture of the occupant. In the arrangement of FIG. 5, the first and second cushions are spaced apart a substantial distance such that second cushion 20 will serve as a knee support for the body 60 of the occupant. In particular, cushions 10, 20 are spaced apart a distance corresponding to at least half the length of the first long side 25 of the second cushion. In the arrangement of FIG. 5, the short side 37 of the third cushion 30 is arranged to engage the second long side 16 of the first cushion 10 and faces generally downwardly toward common plane 52. Also, intermediate side 36 is arranged to face generally in the first horizontal direction 64.

In the arrangement of FIG. 5, the portion of the first cushion 10 adjacent the smaller angle 12 supports the upper back and shoulder area of the user's body 60 and the portion of the third pillow 30 adjacent the angle 33 supports the user's head and neck.

When the cushions 10, 20, 30 are arranged as shown in FIG. 1, they are in condition to effect a first, semi-reclining body posture. To achieve such condition, the smaller angles 12, 22 of pillows 10, 20 are arranged so that they will be disposed in close juxtaposition. The portions of pillows 10, 20 adjacent angles 12, 22 may or may not touch. Long side 35 of third cushion 30 is arranged to engage second long side 16 of first cushion 10 in overlying relationship therewith.

In the first semi-reclining condition of FIG. 1, the portions of the first and second cushions 10, 20 adjacent the smaller angles 12, 22 thereof support the buttocks of the body 60 of the occupant, and the intermediate side 36 of third cushion 30 supports the mid and upper back area of the body 60 of the user. It is also noted that this intermediate side 36 of third cushion 30 faces generally in the first direction 64 when the pillows are arranged as per FIG. 1.

Figure 6:
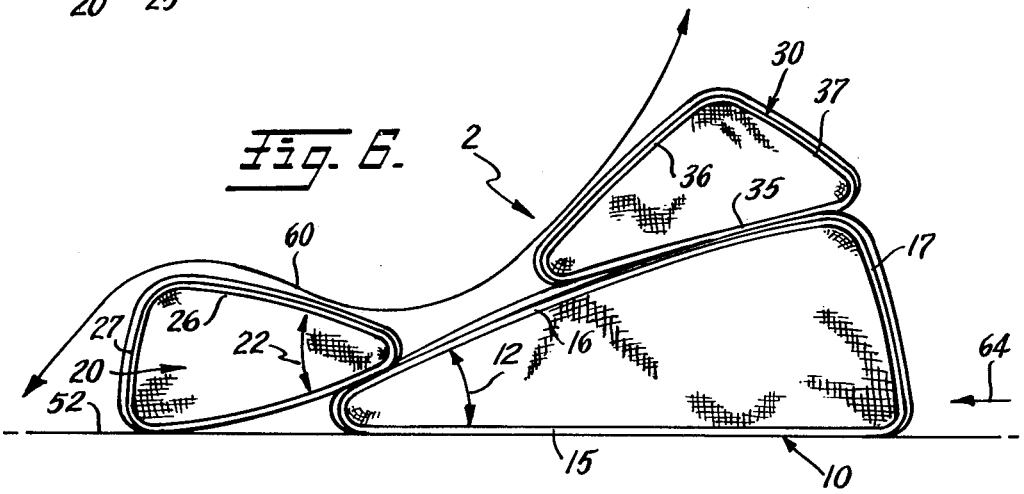
FIG. 6 is a side elevation of a cushion ensemble showing the first, second and third cushions arranged to effect a second, semi-reclining body posture.

FIG. 6 shows cushions 10, 20, 30 arranged into positions to effect a second, semi-reclining body posture. Cushions 10, 20 are arranged such that portions thereof adjacent the smaller angles 12, 22 are in overlapping engagement with each other. Specifically, the first long side 25 of second cushion 20 is arranged to engage second long side 16 of first cushion 10. Cushion 30 is arranged such that intermediate side 36 thereof faces generally in first direction 64.

In the arrangement of FIG. 6 the same portions of body 60 of the user engage generally the same areas of cushions 10, 20, 30. The arrangement of FIG. 6 ensures that no portion of the seat of the user will engage the floor or other surface which defines common plane 52.

Figure 7:
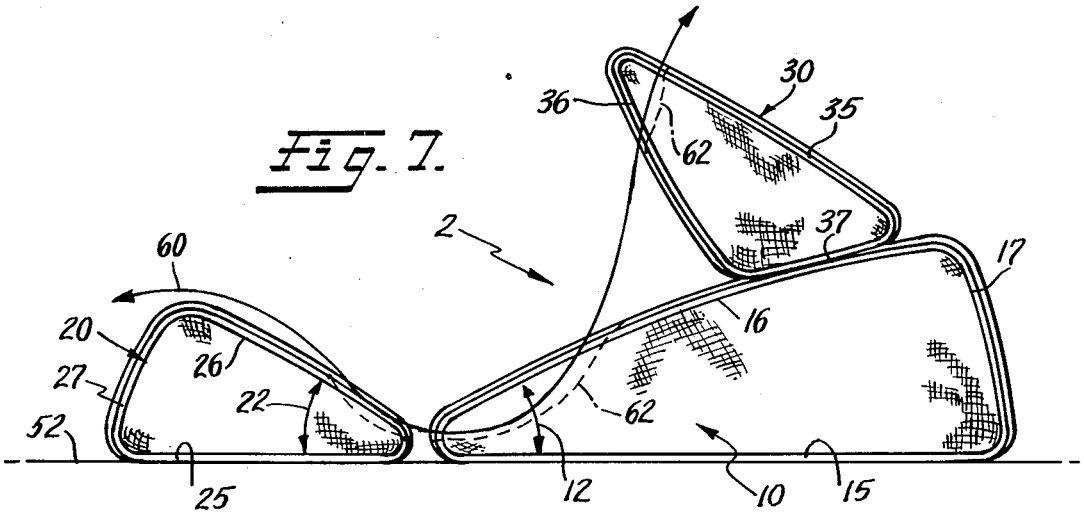
FIG. 7 is a side elevation of a cushion ensemble showing the first, second and third cushions arranged to effect a semi-upright body posture.

FIG. 7 shows pillows 10, 20, 30 arranged to effect a semi-upright body posture. First and second cushions 10, 20 are arranged adjacent each other so that the smaller angles 12, 22 thereof are in close juxtaposition. The portions of pillows 10, 20 adjacent angles 12, 22 may or may not touch. Short side 37 of third cushion 30 faces generally downwardly and is arranged to be in overlying engagement with the second long side 16 of the first cushion 10. The intermediate side 36 of third cushion 30 faces generally in first direction 64.

In the arrangement of FIG. 7, portions of pillows 10, 20 adjacent smallest angles 12, 22 thereof support the buttocks of the user and the portion of third pillow 30 adjacent smallest angle 32 thereof supports the upper back area of the user.

Figure 8:
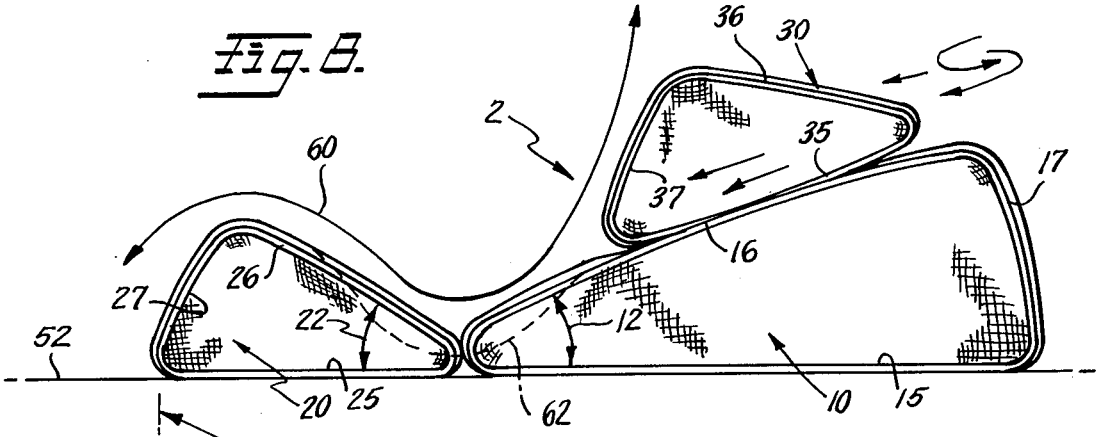
FIG. 8 is a side elevation of a cushion ensemble showing the first, second and third cushions arranged to effect a first upright body posture.

FIG. 8 depicts cushions 10, 20, 30 arranged to effect a first upright body posture. First and second cushions 10, 20 are arranged such that portions thereof adjacent smaller angles 12, 22 engage each other. Third cushion 30 is arranged such that long side 35 thereof faces downwardly and generally toward plane 52. Also, long side 35 of cushion 30 engages second long side 16 of first cushion 10. Short side 37 of third cushion 30 faces in first direction 64.

In the arrangement of FIG. 8, portions of first and second cushions 10, 20 adjacent smallest angles 12, 22 thereof support the buttocks of the user, and short side 37 of third cushion 30 supports the lower back area of the user.

FIG. 10 depicts a condition for effecting a second upright body posture utilizing first, second and third cushions 10, 20, 30 as well as fourth cushion 40 described above and shown in FIG. 9. First and second cushions 10, 20 are arranged so as to be disposed immediately adjacent each other with the smaller angles 12, 22 thereof disposed in close juxtaposition. Portions of cushions 10, 20 adjacent smaller angles 12, 22 may or may not touch. Third cushion 30 is arranged such that long side 35 thereof engages second long side 16 of first cushion 10 in overlying relationship therewith. Intermediate side 36 of third cushion 30 faces generally in first direction 64. Fourth cushion 40 is arranged so as to be disposed on third cushion 30 in overlying relationship therewith. Inwardly converging recess 49 of cushion 40 mates with intermediate and short sides 36, 37 of third pillow 30 and with a corner or edge 68 (FIG. 1) formed by the meeting of intermediate and short sides 36, 37 of third pillow 30 and defined by angle 33 thereof.

In the arrangement of FIG. 10, portions of the first and second cushions 10, 20 adjacent smaller angles 12, 12 thereof support the buttocks of the user, a portion of intermediate side 36 of third cushion 30 supports the mid and lower back area of the user, and a side 41 of fourth cushion 40 supports the upper back and shoulder area of the user.

While the cushion ensemble and method of arrangement of the present invention have been described in connection with certain preferred embodiments and steps, it will be understood that many additions, deletions, modifications, and variations are possible without departing from the spirit and scope of the present invention as defined in the appended claims.

What is claimed is:

1. A cushion ensemble for supporting a body with respect to a supporting surface, the ensemble comprising:

(a) a first cushion which is free about its entire exterior, said first cushion having a cross-sectional shape corresponding generally in an undeformed condition to a first triangle having one angle smaller than the other two angles;

(b) a second cushion which is free about its entire exterior, said second cushion also having a cross-sectional shape corresponding generally in an undeformed condition to a second triangle having one angle smaller than the other two angles;

(c) a third cushion which is free about its entire exterior, said third cushion having a cross-sectional shape corresponding generally in an undeformed condition to a third triangle;

(d) said first and second cushions being arranged such that one side of said first triangle and one side of said second triangle face downwardly for engagement with the supporting surface and such that said smaller angles of said first and second cushions face each other in mutually opposed relationship;

(e) said first cushion being disposed so as to have a first upwardly facing side inclined downwardly toward the supporting surface in a first direction along the supporting surface, said cushion being disposed so as to have a second upwardly facing side inclined downwardly in a second direction, said second direction being opposite said first direction;

(f) said third cushion being disposed on said first upwardly facing side of said first cushion in an unattached, abutting engagement therewith;

(g) said first and second cushions both having first and second long sides, and a short side which is shorter than said long sides, said third cushion having a long side, an intermediate side, and a short side, said sides of each cushion corresponding to sides of said triangles, the lengths of said first and second long sides, respectively, of said first cushion being at least 1.5 times the lengths, respectively, of said first and second long sides of said second cushion and at least 1.5 times the lengths, respectively, of said intermediate and long sides of said third cushion.

2. A cushion ensemble as defined in claim 1 wherein each cushion includes a hollow enclosure of flexible sheet material filled with polystyrene beads.

3. A cushion ensemble as defined in claim 1 wherein said cushions are substantially deformed when supporting a body.

4. A cushion ensemble as defined in claim 1 wherein each cushion has a width dimension in a direction perpendicular to the plane of said first, second and third triangles.

5. A cushion ensemble as defined in claim 1 wherein said width dimensions of said first and second cushions are at least 1.5 times the width dimension of said third cushion.

6. A cushion ensemble as defined in claim 1 wherein said supporting surface is defined by a floor of a building.

7. A cushion ensemble as defined in claim 1 wherein said smaller angle of said first triangle is defined by said first and second long sides of said first cushion, and wherein said smaller angle of said second triangle is defined by said first and second long sides of said second cushion.

8. A cushion ensemble as defined in claim 1 wherein said first long sides of said first and second cushions face downwardly for engagement with the supporting surface and wherein said second long sides of said first and second cushions face generally upwardly away from the supporting surface.

9. A cushion ensemble as defined in claim 1 wherein said first long sides of said first and second cushions fall substantially within a common plane corresponding with the supporting surface, and wherein said second long sides of said first and second cushions face generally upwardly away from said common plane.

10. A cushion ensemble as defined in claim 9 wherein said first and second cushions are spaced apart a distance corresponding to at least half the length of said first long side of said second cushion, wherein said short side of said third cushion engages said second long side of said first cushion and faces generally downwardly towards said common plane, and wherein said intermediate side of said third cushion faces generally in said first direction, whereby said first, second and third cushions are positioned for effecting a reclining body posture.

11. A cushion ensemble as defined in claim 9 wherein said first and second cushions are disposed immediately adjacent each other with said smaller angles thereof disposed in close juxtaposition and wherein said long side of said third cushion engages said second long side of said first cushion in overlying relationship therewith, whereby said first, second and third cushions are positioned to effect a first semi-reclining body posture.

12. A cushion ensemble as defined in claim 11 wherein said intermediate side of said third cushion faces generally in said first direction.

13. A cushion ensemble as defined in claim 8 wherein portions of said first and second cushions adjacent said smaller angles thereof are in overlaping engagement with each other, wherein said long side of said third cushion is in overlying engagement with said second long side of said first cushion, and wherein said intermediate side of said third cushion faces generally in said first direction, whereby said first, second and third cushions are positioned to effect a second semi-reclining body posture.

14. A cushion ensemble as defined in claim 9 wherein said first and second cushions are arranged adjacent each other such that said smaller angles thereof are in close juxtaposition, said short side of said third cushion facing generally downwardly and being in overlying engagement with said second long side of said first cushion, said intermediate side of said third cushion facing generally in said first direction, whereby said first, second and third cushions are arranged to effect a semi-upright body posture.

15. A cushion ensemble as defined in claim 9 wherein portions of said first and second cushions adjacent said smaller angles thereof engage each other, said long side of said third cushion facing downwardly generally toward said supporting surface and engaging said second long side of said first cushion, and said short side of said third cushion facing in said first direction, whereby said first, second and third cushions are positioned to effect a first upright body posture.

16. A cushion ensemble as defined in claim 9, wherein said first and second cushions are disposed immediately adjacent each other with said smaller angles thereof disposed in close juxtaposition, wherein said long side of said third cushion engages said second long side of said first cushion in overlying relationship therewith, and wherein said intermediate side of said third cushion faces generally in said first direction; the cushion ensemble further including a fourth cushion which is free about its entire exterior, said fourth cushion having a cross-sectional shape corresponding generally, in an undeformed condition, to a four-sided closed geometrical figure with three acute internal angles and one internal angle which is greater than 180°, said one greater internal angle defining an inwardly converging recess with respect to the exterior of said fourth cushion, said inwardly converging recess mating with said intermediate and short sides of said third cushion and with a corner formed by the meeting of said intermediate and short sides of said third cushion, whereby said first, second, third, and fourth cushions are positioned to effect a second upright body posture.

* * * * *